US008847156B2

(12) United States Patent
Josland

(10) Patent No.: US 8,847,156 B2
(45) Date of Patent: Sep. 30, 2014

(54) GAS INLET FOR A PROCESS MASS SPECTROMETER

(75) Inventor: Graham David Josland, Cheshire (GB)

(73) Assignee: Thermo Fisher Scientific Inc., Sugar Land, TX (US)

( * ) Notice: Subject to any disclaimer, the term of this patent is extended or adjusted under 35 U.S.C. 154(b) by 914 days.

(21) Appl. No.: 12/769,295

(22) Filed: Apr. 28, 2010

(65) Prior Publication Data

US 2011/0266430 A1 Nov. 3, 2011

(51) Int. Cl.
*H01J 49/00* (2006.01)
*H01J 49/04* (2006.01)

(52) U.S. Cl.
CPC ..... *H01J 49/0431* (2013.01)
USPC ..... 250/288; 250/281; 250/282

(58) Field of Classification Search
USPC ..... 250/281–288
See application file for complete search history.

(56) References Cited

U.S. PATENT DOCUMENTS

| | | | | |
|---|---|---|---|---|
| 4,762,203 | A | 8/1988 | Ryan | |
| 5,103,093 | A * | 4/1992 | Sakairi et al. | 250/288 |
| 6,670,608 | B1 * | 12/2003 | Taylor et al. | 250/288 |
| 7,463,991 | B2 * | 12/2008 | Shajii et al. | 702/100 |
| 8,300,218 | B2 * | 10/2012 | Furtaw et al. | 356/72 |
| 2005/0158876 | A1 | 7/2005 | Davis et al. | |
| 2005/0258358 | A1 * | 11/2005 | Thakur | 250/288 |
| 2007/0075242 | A1 * | 4/2007 | Kruis | 250/288 |
| 2009/0020696 | A1 * | 1/2009 | Bier | 250/288 |
| 2009/0256066 | A1 * | 10/2009 | Soga et al. | 250/252.1 |
| 2011/0101216 | A1 * | 5/2011 | Musselman | 250/282 |

FOREIGN PATENT DOCUMENTS

| | | | |
|---|---|---|---|
| CN | 2388602 | Y | 7/2000 |
| GB | 2471249 | A | 10/2009 |

OTHER PUBLICATIONS

Combined Search and Examination Report issued in corresponding British Application No. GB1106966.3; Dated Sep. 1, 2011 (5 pages).
First Office Action (with translation) issued Jul. 22, 2013 in corresponding Chinese application No. 201110112923.2 (12 pages).
2nd Office Action issued in corresponding Chinese Application No. 201110112923.2; Dated May 26, 2014 (7 pages).

* cited by examiner

*Primary Examiner* — Michael Maskell
(74) *Attorney, Agent, or Firm* — Osha Liang LLP

(57) ABSTRACT

An inlet for a process mass spectrometer, the inlet comprising, a capillary in fluid communication with a sample gas feed; a transfer line in fluid communication to the capillary; a first orifice configured to generate a change in pressure, the orifice comprising at least two measuring ports; a pressure sensor operatively connected to at least one of the two measuring ports; and a second transfer line in fluid communication with the first orifice, the second transfer line also in fluid communication with an external disposal point.

22 Claims, 2 Drawing Sheets

GAS INLET FOR A PROCESS MASS SPECTROMETER

FIELD OF THE INVENTION

Embodiments disclosed herein generally relate to apparatus and methods of introducing a sample fluid into a process mass spectrometer. More specifically, embodiments disclosed herein relate generally to a two-stage gas inlet for a process mass spectrometer.

BACKGROUND

Process mass spectrometers typically have a number of conditioned gas samples, which are filtered and regulated to a small positive pressure, that are delivered on a continuous or intermittent basis. The gas inlet system associated with the spectrometer instrument often has two parts. The first part can be a multi-stream selector responsible for selecting one of the samples for analysis. The second part is responsible for taking the selected sample and delivering the sample into the vacuum of the mass spectrometer ion source. The delivery of the sample to the ion source requires taking a small fraction of the selected gas flow and reducing the pressure to be compatible with that of the ion source.

Typically, the pressure reduction is performed using capillaries and/or orifices as restriction elements to reduce the flow and pressure of the fraction of the sample. Often times, when the fraction of the sample is delivered to the ion source via small apertures, the pressure of the sample delivered to the ion source does not remain constant, especially when the incoming sample composition varies widely, and distortion of the sample can occur.

Accordingly, there is a need for a new gas inlet which allows for the delivery of a gas sample without distorting the composition and while maintaining a constant pressure within the ion source as the sample composition varies and providing rapid response to composition changes.

SUMMARY

According to one aspect, embodiments disclosed herein relate to an inlet for a process mass spectrometer, the inlet comprising, a capillary in fluid communication with a sample gas feed; a transfer line in fluid communication to the capillary; a first orifice configured to generate a change in pressure, the orifice comprising at least two measuring ports; a pressure sensor operatively connected to at least one of the two measuring ports; and a second transfer line in fluid communication with the first orifice, the second transfer line also in fluid communication with an external disposal point.

In another aspect, embodiments disclosed herein relate to an inlet for a process mass spectrometer, the inlet comprising, a first stage having a capillary in fluid communication with a sample gas feed, a first orifice, and a pressure sensor; and a second stage having a second orifice; wherein the first and second stages are in fluid communication with an ion source.

In another aspect, embodiments disclosed herein relate to a method of introducing a sample fluid to an ion source, the method comprising, transferring the sample fluid from a feed through a capillary; generating a pressure change; measuring the pressure change; transferring the sample fluid to a second orifice; and introducing the sample fluid to the ion source.

Other aspects of the invention will be apparent from the following description and the appended claims.

DETAILED DESCRIPTION

Figure 1:
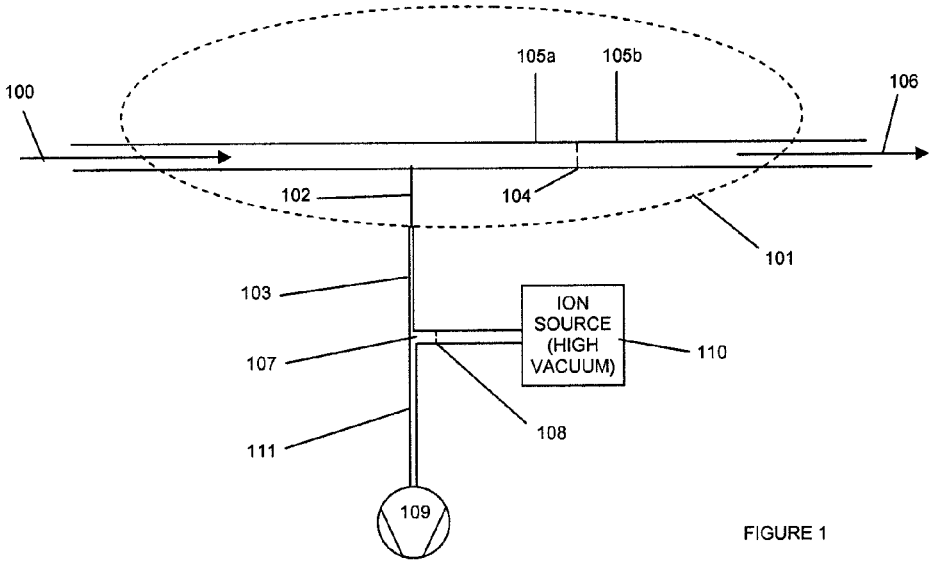
FIG. 1 shows a two-stage inlet in accordance with one or more embodiments of the present disclosure.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments disclosed herein relate to apparatus and methods of introducing a sample fluid into a process mass spectrometer. More specifically, embodiments disclosed herein relate generally to a two-stage gas inlet for a process mass spectrometer.

In designing inlets for introducing fluid samples into process mass spectrometers, several design details are taken into consideration. Initially, the composition of a sample fluid delivered to an ion source of the mass spectrometer should be substantially the same as that of the sample arriving to the inlet of the mass spectrometer. If the flow characteristics of the sample fluid in the inlet are not managed correctly, distortion of the compositions may occur, thereby resulting in incorrect readings by the mass spectrometer. In addition to the fluid characteristics being substantially the same, the pressure of the sample delivered to the ion source should be held relatively constant, even when the incoming sample composition varies. By keeping the pressure relatively constant, the linearity of the mass spectrometer may be extended, thereby extending the dynamic range of validity of the calibration.

During testing, it is also desirable that the response of the inlet to composition changes should be as quick as possible, thereby improving the reliability of the results of the measured sample. Generally, a response time of less than 3.0 seconds for a 99.9% composition change is preferred. Other considerations include using large diameter apertures, thereby decreasing the likelihood that the apertures become blocked, as well as delivering a sample fluid to the ion source without introducing the results of ambient temperature variation to the sample.

Existing single-stage inlets allow for the sampling of fluids, however, because single-stage inlets do not correctly allow for fluid flow characteristic variation, as well as changes to composition of the sample, the results of the testing may not be accurate. Additionally, single-stage inlets often use narrow apertures, thereby increasing the likelihood of blockage during testing.

Referring initially to FIG. 1, a schematic representation of a two-stage inlet for delivering a sample fluid to an ion source is shown. In this embodiment, a sample fluid is delivered to the inlet via sample line 100. Sample line 100 provides fluid communication between the inlet of the process mass spectrometer and an external active fluid system (not shown). As discussed herein, the sample fluid may include various gases, such as, for example, hydrogen, helium, argon, etc. The flow of fluid through sample line 100 may vary based on the type of process, as well as flow restrictors in or before sample line 100.

Sample line 100 may also be fluidly connected to a multiple-stream selector (not shown), which may allow for the sequential selection of one or more samples from various sources. Thus, a single process mass spectrometer may be capable of measuring properties of various discrete streams of fluids from various sources.

Figure 2:
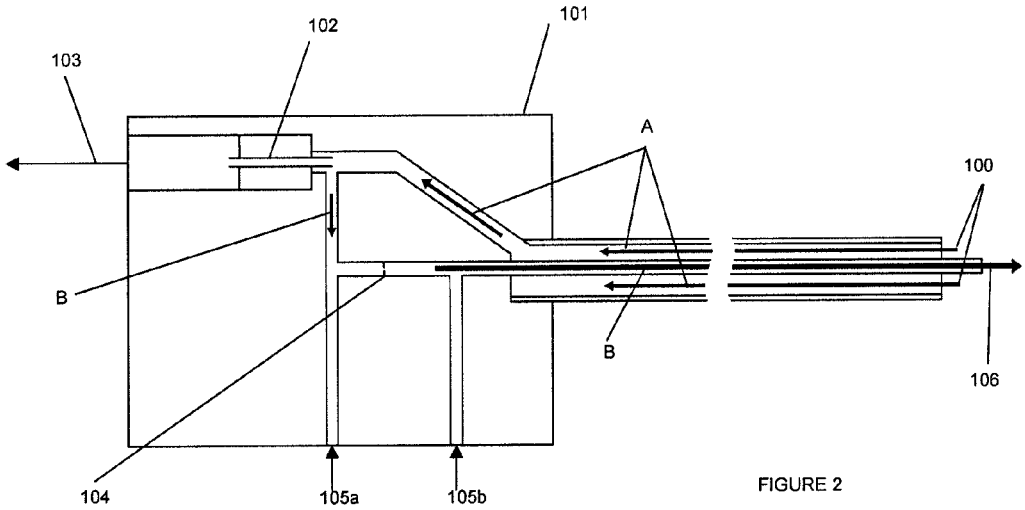
FIG. 2 shows a schematic representation of the first stage of the inlet of FIG. 1 according to embodiments of the present disclosure.

After a sample fluid is transferred from sample line 100, the sample fluid is transferred to a first stage 101. Referring to FIGS. 1 and 2 together, FIG. 2, a detailed diagrammatic representation of a first stage according to embodiments of the present disclosure, is shown. In this embodiment, first stage 101 includes a capillary 102 in fluid communication with the sample line. As fluid is transferred from the sample line, the fluid flows through a passage to a first orifice 104. First orifice 104 provides fluid communication for two fluid pressure points 105*a* and 105*b*. At least one of the two fluid pressure points 105*a* and 105*b* are connected to a pressure sensor (not shown). Various types of pressure sensors may be used, for example, in certain aspects, a differential pressure transducer may be used to determine a pressure dependent on an output voltage signal generated by the transducer.

After the fluid passes through first orifice 104, the fluid continues into a transfer line 106 and out of first stage 101 to an external disposal point (not shown). The flow of fluid into first stage 101 is indicated by directional arrows A, while a return flow of excess fluid not drawn into the capillary 102 is shown by directional arrows B.

Referring back to FIG. 1, a portion of the fluid passing through first stage 101 is then introduced via capillary 102 and transfer line 103 to an intermediate point 107 located between the first stage 101 and a second stage 108. In this embodiment, second stage 108 includes a second orifice (not independently shown). A vacuum pump 109 may be used to draw fluid through capillary 102, transfer line 103, intermediate point 107 and bypass line 111. A second vacuum pump system (not shown) may be used to draw a small quantity of fluid from intermediate point 107 through second stage 108 and into ion source 110.

In order to provide a sample fluid to ion source 110 that allows for accurate measurements of the properties of the sample, the flow characteristics of the sample fluid through first stage 101 and delivering correct pressures to second stage 108, must be maintained. In order for the properties of the fluid to accurately be determined, the flow of the sample fluid through second stage 108 should be molecular in nature. Additionally, the sample fluid flow should have the same characteristics as the flow out of the ion source, which results in little or no distortion of the sample composition.

In order to provide for molecular flow, the pressure at intermediate point 107 must be such that the mean free path of the gas molecules is substantially of the same magnitude as the dimensions of second orifice 108. Testing of various designs indicated that an intermediate pressure at intermediate point 107 of approximately 1.0 mbar and an orifice diameter of approximately 30-70 microns results in such a condition.

In order to balance the conditions in first stage 101 and second stage 108, initially, the flow of the sample through first stage 101 is viscous. To achieve the required pressure at intermediate point 107, a balance between the resistances of upstream and downstream elements (i.e., the capillary 102 and bypass line 111), and the characteristics of these resistances (i.e. the extent to which they behave as tubes and orifices), must be achieved. Examples of dimensions for various components will be discussed in detail below.

In order to achieve the desired flow characteristics, an 8.0 mm internal diameter conduit may be used for the bypass line. Such a bypass line may be combined with a 75 micron internal diameter capillary, wherein the capillary is approximately 12.0 mm in length. This combination results in approximately a 10 ml/min flow rate. Because the internal volume of the capillary is relatively small, the response speed of such a system is less than 1.0 second. Downstream of the capillary, a pressure drop to approximately 1.0 mbar occurs, so the volume of gas to displace is relatively small compared to the total flow, thereby adding negligibly to the response time of the system. In other embodiments, the capillary length may vary between approximately 5.0 and 15.0 mm in length, and the internal diameter may be correspondingly varied.

Because the capillary is relatively small (i.e., 12.0 mm), the assembly can be built compactly, but with sufficient thermal mass that the temperature of the sample may be regulated. By regulating the temperature, effects on the sample fluid that may result from ambient temperature variation may be avoided. In order to further provide for temperature regulation, an environmental casing or temperature adjustable housing may be used.

In order to connect the capillary to the intermediate point, a transfer line 103 having an internal diameter of approximately 2.0 mm may be used. The internal diameter of the transfer line provides a relatively small pressure drop without adding significantly to the response time of the system. The small pressure drop also decreases the likelihood that variations in ambient temperature will have an effect on the sample fluid flow in this portion of the inlet. In other embodiments, variations to the internal diameter of the transfer line may also occur, and as such, transfer lines having an internal diameter of between 1.0 mm and 10.0 mm may also be used.

First stage 101 also includes an orifice that allows for flow measurements to be taken. By measuring the change in pressure across the orifice, the flow of the sample fluid may be determined. Those of ordinary skill in the art will appreciate that various types of pressure sensors may be used to determine the change in pressure across the orifice, but the type of pressure sensor selected should be able to provide differential pressure measurements at relatively low pressures (i.e., approximately 70 mbar), be capable of operating at temperatures up to and exceeding 120° C., and include interchangeable parts that are easy to replace. The size of the orifice may also be adjusted to provide a measurement range of 0.1 to 4.0 L/min, however, those of ordinary skill in the art will appreciate that typical measurements ranges may be between 0.1 and 1.2 L/min, and in many operations, approximately 0.5 L/min.

In addition to the embodiments discussed above, various modifications to inlets according to the present disclosure are also contemplated. For example, in certain embodiments, an inlet for a process mass spectrometer may have a first stage including a capillary in fluid communication with a sample gas feed, as well as a first orifice and a pressure sensor, as discussed above. The second stage may be limited to include a second orifice, thereby providing fluid communication between both the first and second stages and the ion source. The flow of fluid through the first stage may be substantially viscous, while the flow of fluid through the second stage may be molecular. By taking a portion of the fluid flow and reducing the pressure to be compatible with the ion source, distortion of the sample may be decreased, while the linearity of the process mass spectrometer may be extended.

During operation, variations to the process for introducing a sample fluid to an ion source may be used. In one embodiment, a sample fluid is transferred from a feed through a capillary. The capillary may be disposed in or be a portion of a multiple-stream selector, thereby allowing more than one feed fluid to be analyzed. In other embodiments, the capillary may be a conduit independent of a multiple-stream selector, thereby providing for a sample flow from a single source to be tested. After a portion the fluid is transferred to the capillary, a pressure change is generated by passing the excess fluid through an orifice. The pressure change may be measured, such as with a pressure sensor, and the flow characteristics of the sample fluid determined. The sample fluid flowing through the capillary is subsequently transferred to a second orifice and introduced to an ion source.

In certain embodiments, the sample fluid may be transferred from the capillary to an intermediate point prior to transference to the second orifice or to the ion source. In such an embodiment, the pressure may be measured at the intermediate point, and a characteristic of the process mass spectrometer may be adjusted based on the determined pressure at the intermediate point. In still other embodiments, a flow characteristic of the sample fluid may be adjusted in the capillary, thereby delivering an optimized pressure to the second orifice. Such an optimized pressure may thereby introduce the sample fluid to an ion source having substantially the same flow characteristics as a flow of fluid exiting the ion source.

Figure 3:
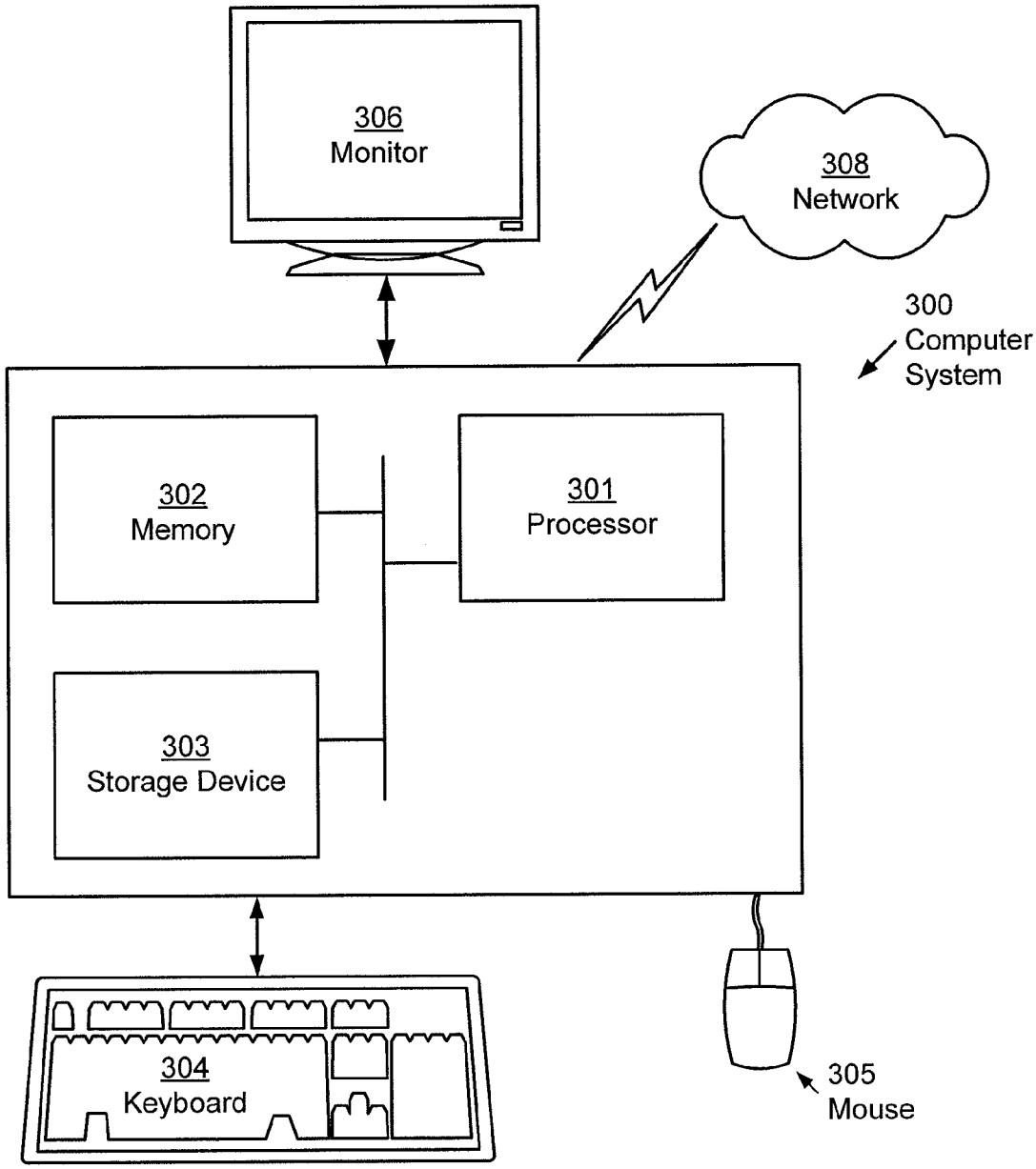
FIG. 3 shows a schematic representation of a computer system according to embodiments of the present disclosure.

The invention may be implemented on virtually any type of computer regardless of the platform being used. For example, as shown in FIG. 3, a computer system 300 includes a processor 302, associated memory 304, a storage device 306, and numerous other elements and functionalities typical of today's computers (not shown). The computer 300 may also include input means, such as a keyboard 308 and a mouse 310, and output means, such as a monitor 312. The computer system 300 is connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system 300 may be located at a remote location and connected to the other elements over a network. Further, the invention may be implemented on a distributed system having a plurality of nodes, where each portion of the invention may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, a file, or any other computer readable storage device.

Advantageously, embodiments of the present disclosure may provide a process mass spectrometer inlet allowing for a sample fluid to be delivered from a fluid feed to an ion source with decreased compositional distortion. By decreasing sample distortion, the results of the mass spectroscopy may have increased accuracy, thereby improving the operation. Also advantageously, embodiments of the present disclosure may deliver the sample to the ion source at a relatively constant pressure, even when incoming sample composition may vary widely. Such embodiments may thereby extend the linearity of the process mass spectrometer, as well as increase the dynamic range of the validity of the calibration of the spectrometer.

Also advantageously, embodiments of the present disclosure may provide for decreased response time for the inlet in response to composition changes. Additionally, embodiments of the present disclosure may provide for an inlet with relatively large apertures, thereby decreasing the likelihood of blockage during use, as well as provide a system that is minimally affected by ambient temperature fluctuations. Further, such temperature fluctuations may be controlled by, for example, including an environmental housing around the capillary and/or other conduits, thereby allowing a relatively constant temperature to be maintained.

Also advantageously, embodiments of the present disclosure may provide for optimized flow and pressure drops through first and second stages, thereby resulting in a high flow rate through the intermediate point. The high flow rates, along with the designs discussed above, may provide for minimized internal volumes and zones of trapped gas, thereby allowing changes in incoming gas compositions to be transferred rapidly to the ion source.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An inlet for a process mass spectrometer, the inlet comprising:

a capillary in fluid communication with a sample gas feed;

a first transfer line in fluid communication to the capillary;

a first orifice configured to generate a change in pressure, the orifice comprising at least two measuring ports;

a pressure sensor operatively connected to at least one of the two measuring ports;

a second transfer line in fluid communication with the first orifice, the second transfer line also in fluid communication with an external disposal point; and a sample line which conveys a sample gas flow to the first orifice and the capillary;

wherein the capillary is in fluid communication with the sample line upstream of the orifice to receive a portion of the sample gas flow and introduce it to a mass spectrometer through the first transfer line.

2. The inlet of claim 1, wherein the capillary comprises an internal diameter of about 75 microns.

3. The inlet of claim 2, wherein the capillary is between about 5.0 and about 12.0 millimeters in length.

4. The inlet of claim 1, wherein the capillary is disposed on a multi-stream selector.

5. The inlet of claim 1, wherein the pressure sensor comprises a differential pressure transducer.

6. The inlet of claim 1, wherein the transfer line comprises an internal diameter of about 2.0 millimeters.

7. The inlet of claim 1, further comprising:

a vacuum pump in fluid communication with the transfer line;

an intermediate point disposed between the vacuum pump and the transfer line; and a second orifice in fluid communication with the intermediate point and the ion source.

8. The inlet of claim 7, wherein the vacuum pump is connected to the intermediate point via a bypass line.

9. The inlet of claim 8, wherein the bypass line comprises an internal diameter of about 8.0 millimeters.

10. An inlet for a process mass spectrometer, the inlet comprising:

a first stage having a capillary in fluid communication with a sample gas feed, a first orifice, a pressure sensor, a first transfer line, a second transfer line, and a sample line which conveys a sample gas flow to the first orifice, wherein the capillary is in fluid communication with the sample line upstream of the orifice to receive a portion of the sample gas flow; and a second stage having a second orifice to receive sample gas from the capillary via the first transfer line;

wherein the first and second stages are in fluid communication with an ion source with sample gas passing through the second stage to the ion source; and wherein the second transfer line is downstream from the first orifice to receive a second portion of the sample gas flow.

11. The inlet of claim 10, further comprising:

an intermediate point disposed between the first and second stages.

12. The inlet of claim 10, wherein flow through the capillary is viscous and flow through the second orifice is molecular.

13. A method of introducing a sample fluid to an ion source, the method comprising:

transferring the sample fluid from a feed through a capillary to a first transfer line;

generating a pressure change with a first orifice;

measuring the pressure change; transferring at least a portion of the sample fluid from the first orifice to an external disposal point via a second transfer line; and introducing the sample fluid to the ion source via the first transfer line;

wherein a sample line conveys a portion of the sample fluid flow to the capillary and the remaining sample fluid flow to the first orifice, and the capillary is in fluid communication with the sample line upstream of the first orifice.

14. The method of claim 13, further comprising:

transferring at least a portion of the sample fluid from the capillary to an intermediate point in fluid communication with a second orifice and the ion source.

15. The method of claim 14, wherein a flow of the fluid through the capillary is viscous and a flow of the fluid through the second orifice is molecular.

16. The method of claim 14, wherein a flow of sample fluid in the second orifice is substantially the same as a flow out of the ion source.

17. The method of claim 14, further comprising:

adjusting flow characteristic of the sample fluid in the capillary and a bypass line; and delivering an optimized pressure to the second orifice.

18. The method of claim 17, wherein the optimized pressure introduces the sample fluid to the ion source having substantially the same pressure for all compositions and substantially the same composition as a flow of fluid in the feed.

19. The inlet of claim 1, wherein gas flow passes through the first orifice before being transferred to the external disposal point.

20. The inlet of claim 10, wherein sample gas passing through the first orifice is transferred to an external disposal point.

21. The inlet of claim 10, further comprising a second pressure sensor, wherein one of the pressure sensors is located upstream from the first orifice and one is located downstream.

22. The method of claim 13, wherein the pressure change is measured across the first orifice by a pressure sensor upstream from the first orifice and a pressure sensor downstream from the first orifice.

* * * * *